US005738415A

United States Patent [19]

Parrott

[11] Patent Number: 5,738,415

[45] Date of Patent: Apr. 14, 1998

[54] PICK HOLDER AND FIXING SLEEVE FOR AN EXTRACTION MACHINE

[75] Inventor: George Albert Parrott, Barnsley, England

[73] Assignee: Minnovation Limited, Barnsley, United Kingdom

[21] Appl. No.: 666,555

[22] PCT Filed: Dec. 23, 1994

[86] PCT No.: PCT/GB94/02815

§ 371 Date: Aug. 30, 1996

§ 102(e) Date: Aug. 30, 1996

[87] PCT Pub. No.: WO95/18914

PCT Pub. Date: Jul. 13, 1995

[30] Foreign Application Priority Data

Jan. 5, 1994 [GB] United Kingdom ..... 9400114

[51] Int. Cl.[6] ..... E21C 35/197

[52] U.S. Cl. ..... 299/104; 299/106

[58] Field of Search ..... 299/81.1, 104, 299/106

[56] References Cited

U.S. PATENT DOCUMENTS

| | | | |
|---|---|---|---|
| 4,678,238 | 7/1987 | Emmerich | 299/81.1 |
| 5,498,069 | 3/1996 | Siebenhofer et al. | 299/106 |

FOREIGN PATENT DOCUMENTS

| | | |
|---|---|---|
| 2915510 | 2/1979 | Germany . |
| 2854307 | 7/1980 | Germany . |
| 2024287 | 1/1980 | United Kingdom . |
| 2092205 | 8/1982 | United Kingdom . |

*Primary Examiner*—David J. Bagnell

*Attorney, Agent, or Firm*—Trexler, Bushnell, Giangiorgi & Blackstone, Ltd.

[57] ABSTRACT

A pick box (3) and sleeve (6) combination comprises a sleeve-receiving aperture (5) in the box (3), with the sleeve (6) located in the aperture (5) and adapted, in use, to receive the shank (17) of a mineral cutter pick (7). A zone (33) of differential area is provided between the external periphery of the sleeve (6) and the aperture (5). A fluid sealing ring (29) is located to each side of the zone (33) of differential area, and a hydraulic fluid entry bore (30) is located intermediate the two sealing rings (29) and is in fluid flow communication with the zone (33), whereby upon admission of hydraulic fluid under sufficient pressure to the zone (33) via the entry bore, the fluid, being confined by the sealing rings (29), effects hydraulic, axial displacement of the sleeve (6) with respect to the box (3). The invention also includes a mineral cutting drum (1) provided with a plurality of such pick and box combinations, and also to a machine provided with at least one such drum.

14 Claims, 2 Drawing Sheets

PICK HOLDER AND FIXING SLEEVE FOR AN EXTRACTION MACHINE

Figure 1:
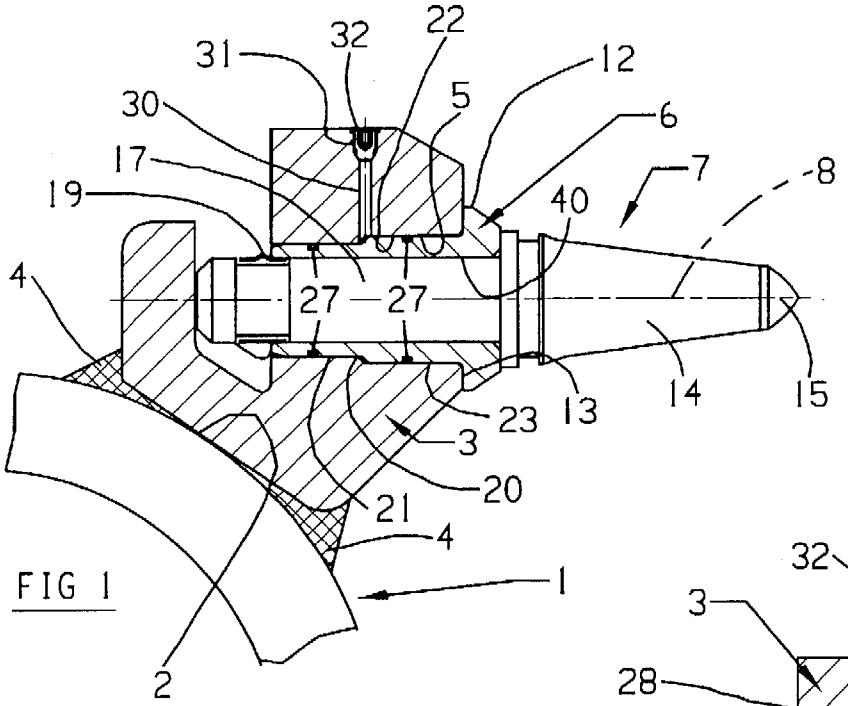

This invention relates to a pick box and liner sleeve combination, adapted to receive the shank of a replaceable, mineral cutter pick, and to a mineral cutter drum provided with such a pick box, as are used extensively in mineral mining operations, in tunnelling operations, in quarrying operations, and in so-called road planing operations.

It is known to insert a replaceable liner sleeve (also known as an adaptor) into a circular section aperture of a pick box, into which liner sleeve is fitted the shank of the pick, so that the sleeve is interposed between the aperture of the pick box and the shank of the pick. The advantage of a liner sleeve is that in-service wear (which occurs due to pick and/or sleeve rotation and impaction) is inflicted on the liner sleeve rather than the box, because when wear has occurred to such an extent that a pick shank cannot be retained satisfactorily, the worn sleeve may be removed and replaced by a fresh sleeve, which avoids the need to remove the associated cutting drum to a safe zone of a mine, or even out of the mine, so that a damaged pick box may be removed and a fresh pick box welded in place. Furthermore, sleeve removal may be necessary not because the sleeve is damaged, but because a pick has been broken off, and its shank remains in the sleeve.

Ideally, the sleeve should be a non-rotating, and hence tight, fit to minimise premature wear, but difficulties are however encountered in removing "tight" liner sleeves, as these have usually been firmly impacted in the aperture of the pick box due to loading which occur in service. Thus, currently, miners are obliged to employ tools such as screw-jacks and/or hydraulic jack for insitu removal of a tight sleeve, assuming the box is of open construction, whereby the rear of the sleeve is exposed and hence engageable by the screw-jack. Screw-jack operation in the confines of a mineral face on a rotary cutter drum provided with say 50 picks, is an awkward and time consuming operation, with loss of mineral production until the cutter drum is ready for service. With a closed box, screw-jack removal is impossible. Frequently, sleeve extraction difficulties, which difficulties themselves sometimes lead to the need to remove the cutting drum from the mining machine to a safe area, or even out of the mine, for the burning-off of pick boxes that house liner sleeves that cannot be extracted—the very action that the use of a liner sleeve seeks to avoid. Hence, an alternative option has been to provide loose-fit liner sleeves and to accept the disadvantages of premature wear.

Sleeve extraction has been a long recognised problem with, to date, no satisfactory solution. Thus, in 1979, in DE 2915510, the VOEST company proposed the introduction of a lubricant being the outer periphery of a sleeve of constant external diameter and the sleeve-receiving bore of the pick box.

In contrast to the constant diameter sleeve of VOEST, a stepped sleeve positively retained mechanically in the sleeve-receiving bore of the pick box by a roll pin is described in U.S. Pat. No. 4,678,238 of the Fansteel but Applicants are unaware whether the Fansteel system has ever been used in service. In the Fansteel system, which addresses the problem of pick cooling to minimise metallurgical damage—as the picks frequently "glow" in action with a tendency for spontaneous methane ignition in coal mining—and also to wash dust and debris away from the pick by used cooling water existing as a spray from an outlet bore of the sleeve.

A basic object of the present invention is to provide a pick box and sleeve combination, in which the sleeve can be readily and quickly removed, e.g. whilst located at an underground mineral face.

According to a first aspect of the present invention there is provided a pick box and sleeve combination comprising;

(i) a sleeve-receiving aperture in the box;

(ii) a replaceable liner sleeve located in the aperture and adapted, in use, to receive the shank of a mineral cutter pick;

(iii) a zone of differential area provided between the external periphery of the sleeve and the aperture;

(iv) a fluid seal located to each side of the zone of differential area; and (v) a hydraulic fluid entry bore located intermediate the two fluid seals and in fluid flow communication with the zone of differential area, whereby upon admission of hydraulic fluid under sufficient pressure to the zone of differential area via the entry bore, the fluid, being confined by the seals, effects hydraulic axial displacement of the sleeve with respect to the box.

According to a second aspect of the invention there is provided a mineral cutting drum provided with a plurality of pick boxes in accordance with the first aspect.

According to a third aspect of the invention there is provided a machine, such as a mining or tunnelling machine, incorporating at least one mineral cutting drum in accordance with the second aspect.

Thus, in accordance with the invention the sleeve is initially axially displaceable hydraulically as a first step (until the outermost fluid seal exits the aperture) in the extraction process, with the hydraulic pressure not only tending to compress the sleeve and hence slightly reducing its external diameter and/or tending to expand the box and hence slightly increasing the aperture diameters The hydraulic action thus has the effect of cracking the retaining forces between the external periphery of the sleeve and the aperture of the box, and thereafter a simple extraction tool, such as a screwdriver, may engage the sleeve to complete the extraction process.

In practice, the fluid entry bore may itself have an inlet end closed off by a hydraulic adaptor, whereby the simple application of a grease gun, or other hand pump, to the hydraulic adaptor achieves hydraulic, axial displacement of the sleeve. Alternatively, the inlet end of the fluid entry bore maybe screw-threaded, so that a screw-threaded end fitting of a hose line maybe screwed into the inlet end of the fluid entry bore. With this last mentioned arrangement, debris ingress into the inlet end of the fluid entry bore may be prevented by insertion of a screw threaded plug, which is removable to enable hydraulic displacement to be effected. Alternatively, if a source of pressure fluid, such as the water/oil emulsion coventionally employed to power hydraulic rams, or high pressure water, is available, then this source may be connected to the individual fluid supply bores, as typically some 50 to 80 pick boxes would be provided on a rotary cutting head.

The fluid seals may take the form of "O"-rings located in grooves.

Figure 2:
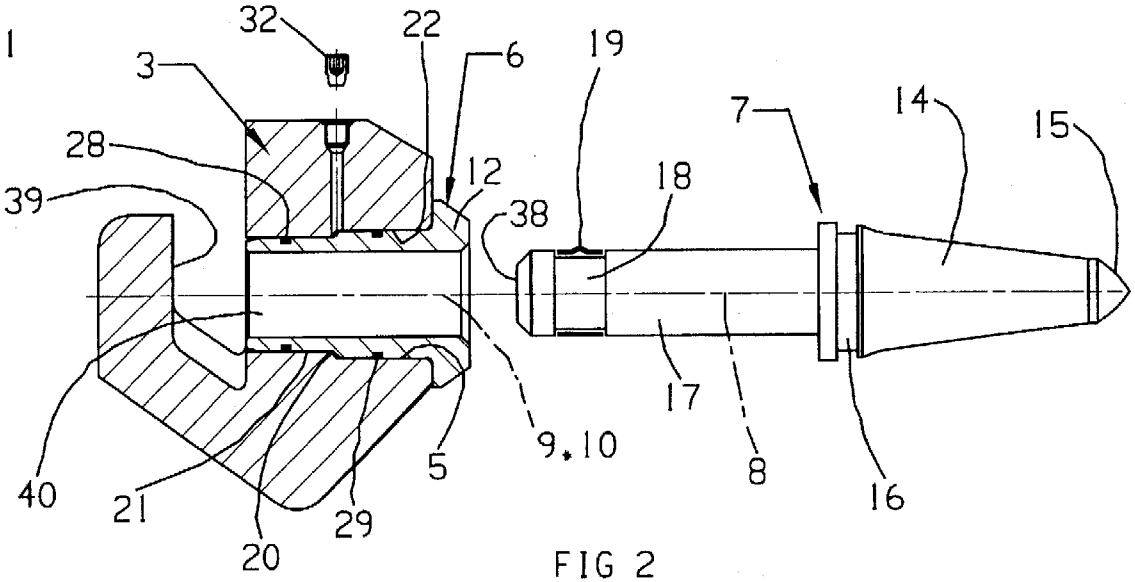
Figure 4:
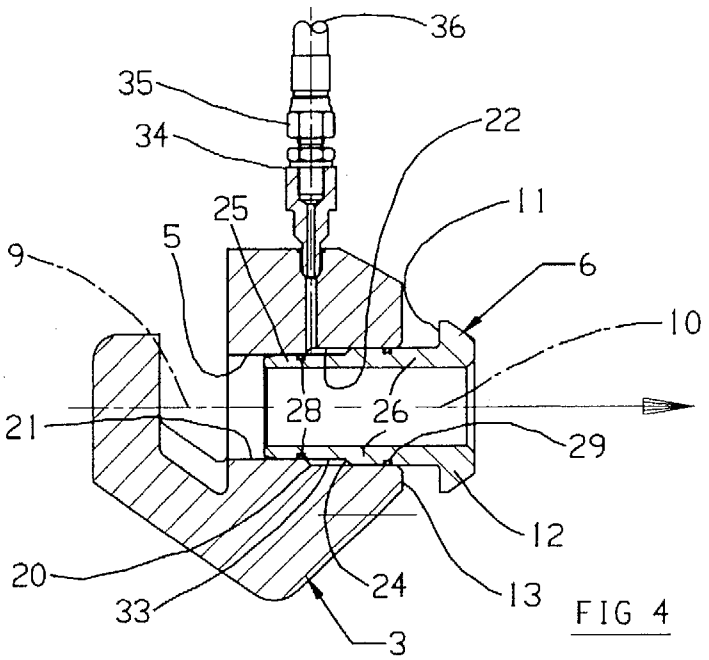
Figure 6:
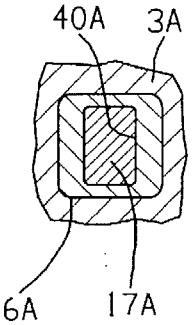
Figure 3:
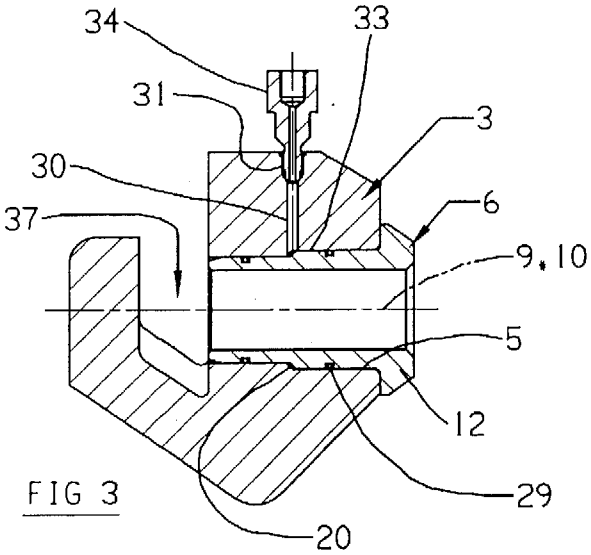
Figure 5:
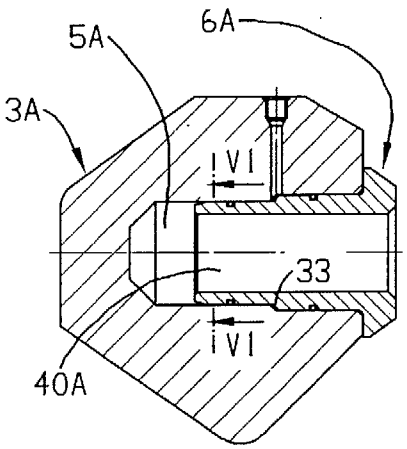

The invention will now be described in greater detail, by way of example, with reference to the accompanying drawings, in which:

FIG. 1 shows a pick box in accordance with a first aspect of the invention welded to a drum in accordance with the second aspect of the invention;

FIG. 2 corresponds to FIG. 1 but shows the pick removed prior to commencement of the sleeve extraction process;

FIG. 3 corresponds to FIG. 2 but shows the sleeve about to be removed;

FIG. 4 corresponds to FIG. 3 but shows the sleeve after hydraulic displacement, as the first step in the extraction process;

FIG. 5 corresponds to FIGS. 1 to 3, but shows a second embodiment of pick box; and FIG. 6 is a section on the line VI—VI of FIG. 5.

In FIG. 1, a rotary mineral cutter drum 1 is mounted on a mining machine (not shown). To external periphery 2 of the drum is welded a plurality of pick boxes, one only shown at 3 secured by weld metal 4.

In FIGS. 1 to 4, each pick box 3 is provided with a circular section aperture 5 into which is fitted a replaceable liner sleeve 6 into which is fitted a replaceable mineral cutter pick 7, the pick sleeve and aperture having co-incident longitudinal axes 8, 9 and 10 respectively. Penetration of the sleeve 6 is limited by underside 11 of an integral collar 12 of the sleeve engaging an outer surface 13 of the pick box 3, whilst the sleeve 6 has a circular aperture 40.

The pick 7 has a head 14 which is provided at one end with a carbide tip 15 and at the other end with a circumferential groove 16 for engagement by a mechanical extraction tool (not shown); The head 14 is integral with a circular section shank 17 adapted to be fitted by hand into the sleeve aperture 40, and being provided with a circumferential groove 18 in which is located a compressable spring ring 19 for pick retention.

All the above features are known.

In accordance with the invention the aperture 5 is provided with a step at 20 e.g. at 45° to longitudinal axis 10, the step 20 separating a smaller diameter length 21 from a larger diameter length 22. Correspondingly, external periphery 23 of the sleeve 6 is provided with a step 24 also at 45° to longitudinal axis 9 to separate a smaller diameter inner length 25 from a larger diameter outer length 26. Thus, the steps 20 and 24 define an annular zone 33 of differential area.

To each side of the step 24, the sleeve 6 is provided with a circumferential groove 27, each housing a fluid seal in the form of an inner "O"-ring 28 and an outer "O"-ring 29, each "O"-ring sealingly engaging respectively the aperture lengths 21 and 22, whilst, when the underside 11 of the collar 12 engages the surface 13, the steps 20 and 24 also engage, or are slightly spaced from one another.

The pick box 3 is also provided with a fluid entry bore 30 having an inlet end 31 counterbored and screw-threaded to receive a removable screw-threaded plug 32. At its other end the fluid entry bore is open and in fluid flow engagement with the zone 33 of differential area between the aperture 5 and the external periphery 23 of the sleeve 6.

The "in service" position is indicated in FIG. 1, with a pick 7 fitted into a sleeve 6 in turn fitted into the aperture 5 of a pick box 3.

When pick replacement is required, the pick 7 is extracted in the conventional manner by a screwdriver etc., being engaged in the groove 16, to lever the pick from the sleeve. This is the situation illustrated in FIG. 2.

When additionally or alternatively replacement of the sleeve 6 is also required, then in accordance with the invention, the plug 32 is removed, as illustrated in FIG. 2, and into the inlet end 31 is screwed a hydraulic adaptor 34, as illustrated in FIG. 3. In turn, an end fitting 35 of a hydraulic fluid supply line 36, is screwed into the hydraulic adaptor 34 and hydraulic fluid, e.g. a water/oil emulsion, as is readily available in mines for activating hydraulically powered roof supports, is applied. This provides pressure fluid to the zone 33 of the differential area provided by steps 20 and 24 result in the sleeve 6 being jacked out of the aperture 5 by being axially displaced as is illustrated in FIG. 4. When the outer "O"-ring 29 exits the outer length 22 of the aperture 5, the effect of hydraulic pressure within the zone 33 of differential area is lost, and the first stage of sleeve extraction is finished. Total sleeve extraction may then be effected by a screw-driver etc., engaging the underside 11 of the collar 12 to lever the sleeve 6 from the aperture 5.

After shutting off the fluid flow the end fitting 35 is disconnected and the hydraulic adaptor 34 is replaced by the plug 32.

This process is of course repeated at every pick box of a cutting drum where sleeve replacement is required.

The embodiment of pick box 3 illustrated in FIGS. 1 to 4 is "open" in that a slot 37 is provided whereby end 38 of the pick shank 17 may engage an anvil portion 39 of the pick box 3, whereby the loading on the pick 7 in service is distributed between the anvil portion 39 and, via the sleeve 6, the leading end of the pick box 3. The slot 37 however provides access to the end of the sleeve 6 remote from the collar 12.

However, the embodiment of pick box 3A illustrated in FIGS. 5 and 6 is of a "closed" type, in that no slot 37 is provided and consequently the present invention is particularly suited to this type of pick box. Also in contrast to FIGS. 1 to 4, the aperture 5A in the pick box 3A is rectangular, to receive a sleeve 6A with a rectangular external periphery. Furthermore, FIG. 6 illustrates the possiblity of the aperture 40A of the sleeve 6A being rectangular, to receive a rectangular shank 17A of an industry-standard pick.

I claim:

1. A pick box and sleeve combination comprising:

(i) a sleeve-receiving aperture in the box;

(ii) a replaceable liner sleeve located in the aperture and adapted, in use, to receive the shank of a mineral cutter pick;

(iii) a zone of differential area provided between the external periphery of the sleeve and the aperture;

(iv) a fluid seal located to each side of the zone of differential area; and (v) a hydraulic fluid entry bore located intermediate the two fluid seals and in fluid flow communication with the zone of differential area, whereby upon admission of hydraulic fluid under sufficient pressure to the zone of differential area via the entry bore, the fluid, being confined by the seals, effects hydraulic axial displacement of the sleeve with respect to the box.

2. A combination as claimed in claim 1 wherein the sleeve-receiving aperture in the box is circular.

3. A combination as claimed in claim 1 wherein the sleeve receiving aperture in the box is non-circular.

4. A combination as claimed in claim 1, wherein the liner sleeve has a circular aperture to receive a circular section pick shank.

5. A combination as claimed in any one of claims 1 to 3, wherein the liner sleeve has a rectangular aperture to receive a rectangular section pick shank.

6. A combination as received in claim 1, wherein the zone of differential area is provided by a step in the box aperture and by a step in the externally periphery of the sleeve.

7. A combination as claimed in claim 6, wherein the step of the aperature is at approximately 45° to a longitudinal axis of the aperture.

8. A combination as claimed in claim 6, wherein the step of the sleeve is at approximately 45° to a longitudinal axis of the sleeve.

9. A combination as defined in claim 1, wherein the fluid entry bore has an inlet end which is screw-threaded.

10. A combination as claimed in claim 9, wherein the screw-threaded inlet end is provided with a removable, screw-threaded plug.

11. A combination as claimed in claim 1, wherein each fluid seal is defined by a sealing ring.

12. A combination as claimed in claim 11, wherein the sealing rings are housed in peripheral grooves provided in the external periphery of the sleeve.

13. A mineral cutter drum provided with a plurality of pick box and sleeve combinations, as defined in claim 1.

14. A mining machine provided with at least one mineral cutter drum as defined in claim 13.

* * * * *